US011183046B2

(12) United States Patent
Werner et al.

(10) Patent No.: US 11,183,046 B2
(45) Date of Patent: Nov. 23, 2021

(54) HAZARDOUS CHEMICAL DETECTION IN A MICROWAVE OVEN

(71) Applicant: International Business Machines Corporation, Armonk, NY (US)

(72) Inventors: John S. Werner, Fishkill, NY (US); Kavita Sehgal, Poughkeepsie, NY (US); Diane Marie Stamboni, Poughkeepsie, NY (US); Sneha Mary Varghese, Fishkill, NY (US); Nicholas George Danyluk, Long Island City, NY (US); Sarah Wu, Kingston, NY (US)

(73) Assignee: International Business Machines Corporation, Armonk, NY (US)

( * ) Notice: Subject to any disclaimer, the term of this patent is extended or adjusted under 35 U.S.C. 154(b) by 169 days.

(21) Appl. No.: 16/550,801

(22) Filed: Aug. 26, 2019

(65) Prior Publication Data

US 2021/0065531 A1 Mar. 4, 2021

(51) Int. Cl.

| | |
|---|---|
| ***G08B 21/12*** | (2006.01) |
| ***H05B 6/64*** | (2006.01) |
| ***G08B 5/22*** | (2006.01) |
| ***G08B 21/18*** | (2006.01) |

(52) U.S. Cl.

CPC ..... *G08B 21/12* (2013.01); *G08B 5/22* (2013.01); *G08B 21/182* (2013.01); *H05B 6/6461* (2013.01)

(58) Field of Classification Search

CPC ..... G08B 21/12; G08B 5/22; G08B 21/182; H05B 6/6461

See application file for complete search history.

(56) References Cited

U.S. PATENT DOCUMENTS 4,786,773 A 11/1988 Keefer
4,864,088 A 9/1989 Hiejima
(Continued)

FOREIGN PATENT DOCUMENTS

KR 20020086388 A 11/2002

OTHER PUBLICATIONS

Korotcenkov, G., "Chemical Sensors: Fundamentals of Sensing Materials", vol. 1: Basic Principles and Materials of Chemical Sensors. Harbin Institute of Technology Press, China (2013), 224 pages (specifically p. 75).
(Continued)

*Primary Examiner* — Hongmin Fan
(74) *Attorney, Agent, or Firm* — Stephanie L. Carusillo

(57) ABSTRACT

In an apparatus for hazardous chemical detection in a microwave oven, a microwave oven comprises an electromagnetic wave shielding material, at least one chemiresistor, a microcontroller, and a digital display, wherein the at least one chemiresistor is overlaid by the electromagnetic wave shielding material, and the microcontroller is electronically coupled to the digital display. In an approach to detect the release of a hazardous chemical during a cooking cycle in a microwave oven, a processor receives a reading from at least one chemiresistor, wherein the at least one chemiresistor is configured to detect a chemical. A processor determines whether a pre-set threshold is met. In response to the pre-set threshold being met, a processor sends an alert.

19 Claims, 5 Drawing Sheets

(56) References Cited

U.S. PATENT DOCUMENTS

| | | | | |
|---|---|---|---|---|
| 5,246,674 | A * | 9/1993 | Katschnig | A61L 2/12 422/302 |
| 6,658,915 | B2 | 12/2003 | Sunshine | |
| 7,525,074 | B2 | 4/2009 | Bostick | |
| 8,760,307 | B2 | 6/2014 | Falcioni | |
| 2003/0209544 | A1* | 11/2003 | Jeung | H05B 6/6402 219/756 |
| 2007/0278220 | A1 | 12/2007 | Bostick | |
| 2013/0308678 | A1* | 11/2013 | Bach | G01K 13/02 374/142 |
| 2020/0367692 | A1* | 11/2020 | Stipe | G08B 5/36 |

OTHER PUBLICATIONS

Waxman, O., "That Plastic Container You Microwave In Could Be Super-Toxic", Time, Diet Health/Nutrition, May 4, 2016, <http://time.com/4229503/plastic-in-microwave-is-it-safe/>, 2 pages.

* cited by examiner

HAZARDOUS CHEMICAL DETECTION IN A MICROWAVE OVEN

BACKGROUND

The present invention relates generally to chemical sensors, and more particularly to utilizing chemical sensors to detect the release of a hazardous chemical during a cooking cycle in a microwave oven.

A microwave oven is a common kitchen appliance that cooks, heats, melts, or defrosts food by means of high-frequency electromagnetic waves called microwaves. Generally, a microwave oven consists of a high-voltage power source, a magnetron, a metal waveguide, a metal cooking chamber, a turntable, and a control panel.

The process of cooking, heating, melting, or defrosting food begins with the high-voltage power source. The high-voltage power source passes energy to the magnetron. The magnetron, an electric vacuum tube, uses this energy to generate high frequency microwaves. The microwaves are funneled through the metal waveguide and are evenly distributed within the metal cooking chamber of the oven. The microwaves are then absorbed by the food, causing the water molecules in the food to vibrate. The resulting friction cooks, heats, melts, and/or defrosts the food. To ensure that the food cooks evenly, the turntable rotates the food around the metal cooking chamber.

Additionally, a microwave oven has a metal cooking chamber that prevents the microwaves from leaking out of the microwave oven. Acting as an electromagnetic shield to prevent radiation from the microwaves from passing through the window, a microwave oven also has a perforated metal plate fitted into the window of the microwave oven's door. In order to maintain electromagnetic shielding, the size of the perforations in the metal plate are purposefully designed to be smaller than the microwaves' wavelength so that microwave radiation cannot pass through the window of the door, but visible light, which has a much shorter wavelength, can pass through.

SUMMARY

Aspects of an embodiment of the present invention disclose an apparatus comprising: an electromagnetic wave shielding material; at least one chemiresistor; a microcontroller; and a digital display, wherein the at least one chemiresistor is overlaid by the electromagnetic wave shielding material, and the microcontroller is electronically coupled to the digital display.

Aspects of an embodiment of the present invention disclose a method and a computer system for detecting the release of a hazardous chemical during a cooking cycle in a microwave oven. A processor receives a reading from at least one chemiresistor, wherein the at least one chemiresistor is configured to detect a chemical. A processor determines whether a pre-set threshold is met. A processor sends an alert.

DETAILED DESCRIPTION

Embodiments of the present invention recognize that food is microwaved in a variety of food containers described or labelled as "microwave safe." These food containers, however, may still contain chemicals harmful to people. These chemicals can leach out of the food containers and into the food during a microwave cooking cycle. Commonly used food containers are made of polycarbonate plastics that contain bisphenols (i.e., bisphenol A or BPA, bisphenol S or BPS, and/or bisphenol AF or BPAF) and phthalates, which are dangerous for human consumption. Embodiments of the present invention further recognize that some manufacturers of these food containers are developing products that they claim do not contain hazardous chemicals. For example, some manufacturers are developing food containers that are "BPA-free." Although advertised and labeled in this manner, some of these products still contain some amount of BPA.

Embodiments of the present invention recognize the need for a device that can identify when a chemical, such as a bisphenol or a phthalate, leaches out of a food container during a microwave oven's cooking cycle. Additionally, embodiments of the present invention recognize the need for a device capable of analyzing and transmitting data in a timely manner to decrease the potential of exposure to such chemicals. The device can decrease the potential of exposure by alerting a user when possible contamination occurs so that the user can dispose of the food container and the food.

Embodiments of the present invention, therefore, provide a microwave oven containing one or more chemiresistors protected by an electromagnetic wave shielding material inset in an interior side wall of the microwave oven. The one or more chemiresistors can detect a vapor and/or gas of a hazardous chemical that has been released from a food container into the cooking chamber of the microwave oven during a cooking cycle. The microwave oven further contains a microcontroller for receiving readings from the one or more chemiresistors and outputting an alert to a user when a hazardous chemical has been detected.

Embodiments of the present invention further provide a chemical injector inset in an interior side wall of the microwave oven. The chemical injector can inject a chemical, which is safe for human consumption, into the cooking chamber of the microwave oven. If a hazardous chemical leaches out of a food container during a cooking cycle, the injected chemical will react with the hazardous chemical. From this chemical reaction, a vapor and/or gas of a hazardous chemical is released that is detectable by the one or more chemiresistors. The chemical injector purposely causes the chemical reaction to produce a by-product for which the one or more chemiresistors are capable of detecting.

The present invention will now be described in detail with reference to the Figures.

Figure 1:
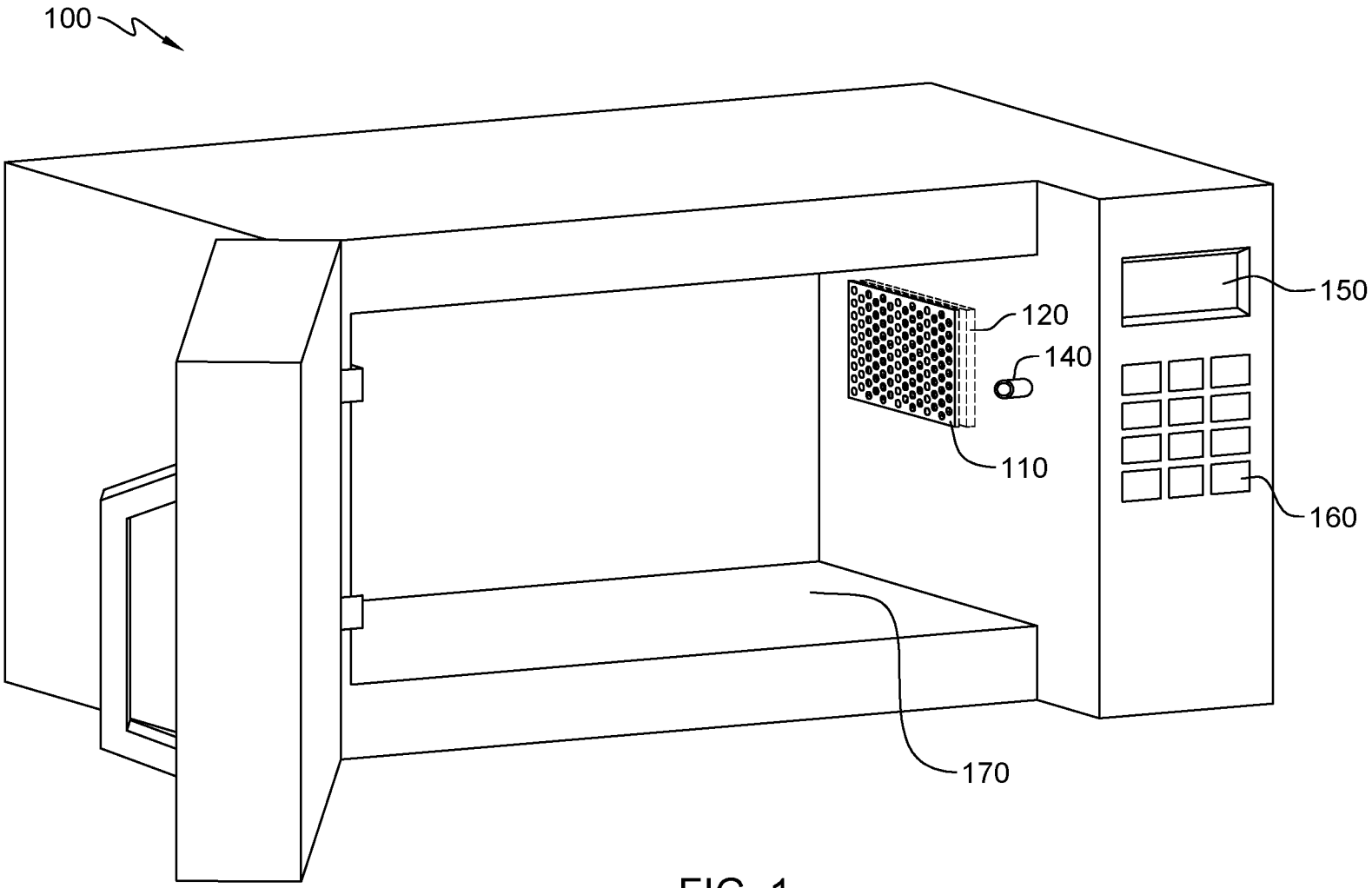
FIG. 1 depicts a perspective view of a microwave oven, in accordance with an embodiment of the present invention.

FIG. 1 depicts a perspective view of microwave oven 100, in accordance with an embodiment of the present invention. In the depicted embodiment, microwave oven 100 operates to cook, heat, melt, or defrost food by means of high-frequency electromagnetic waves called microwaves. In the depicted embodiment, microwave oven 100 includes electromagnetic wave shielding material 110, chemiresistors 120, chemical injector 140, digital display 150, keypad 160, and cooking chamber 170. FIG. 1 provides only an illustration of one embodiment and does not imply any limitations with regard to environments in which different embodiments may be implemented.

Electromagnetic wave shielding material 110 operates to prevent electromagnetic waves from passing through by blocking the electromagnetic waves with a conductive or magnetic barrier. In an embodiment, electromagnetic wave shielding material 110 protects chemiresistors 120 against the electromagnetic field that is created within cooking chamber 170 of microwave oven 100 during a cooking cycle, which can cause temporary disturbances and/or complete degradation of chemiresistors 120. In an embodiment, electromagnetic wave shielding material 110 is composed of Mu-metal, brass, aluminum, silver, nickel, stainless steel, metalized plastic, and/or conductive carbon/graphite composites. In an embodiment, electromagnetic wave shielding material 110 contains small openings to allow air and/or chemical vapors and/or gases to reach chemiresistors 120 while preventing microwaves from negatively impacting chemiresistors 120. The small openings in electromagnetic wave shielding material 110 are large enough that microwave radiation cannot pass through, but air and/or chemical vapors and/or gases can still pass through (e.g., $1/10^{th}$ to $1/20^{th}$ of the wavelength of the microwave radiation). In an embodiment, electromagnetic wave shielding material 110 is coupled to an interior side wall of microwave oven 100 and a front face of chemiresistors 120. In an embodiment, electromagnetic wave shielding material 110 is inset in the interior side wall of microwave oven 100 closest to digital display 150 and keypad 160.

Chemiresistors 120 operate to detect for the release of vapors and/or gases of hazardous chemicals in cooking chamber 170 of microwave oven 100 during a cooking cycle. In an embodiment, chemiresistors 120 operate to detect for the release of vapors and/or gases of hazardous chemicals including, but not limited to, bisphenols and phthalates, which can also be referred to as a "target chemical". In an embodiment, chemiresistors 120 include chemiresistors that output "true" or "false" readings. A "true" reading indicates the target chemical was detected, whereas a "false" reading indicates the target chemical was not detected. In another embodiment, chemiresistors 120 include chemiresistors that output a numerical value denoting a change in resistance and an amount of the target chemical detected.

In an embodiment, chemiresistors 120 includes one chemiresistor. In another embodiment, chemiresistors 120 includes a plurality of chemiresistors. In an embodiment, each chemiresistor of chemiresistors 120 detects for the release of a vapor and/or gas of one hazardous chemical (e.g., one chemiresistor detects for $CO_2$, one chemiresistor detects for BPA, and/or one chemiresistor detects for a phthalate). In another embodiment, a plurality of chemiresistors detects for the release of a vapor and/or gas of the same hazardous chemical (e.g., three chemiresistors detect for $CO_2$, three chemiresistors detect for BPA, and/or three chemiresistors detect for a phthalate). In an embodiment with a plurality of chemiresistors, the use of a plurality of chemiresistors for one hazardous chemical can help prevent false positive readings (e.g., an alert is only triggered if more than one or a majority of chemiresistors have a positive reading). In other embodiments, microwave oven 100 may include other types of sensors for detecting hazardous chemicals.

In an embodiment with a plurality of chemiresistors, chemiresistors 120 are distributed evenly in columns and rows. In other embodiments with a plurality of chemiresistors, chemiresistors 120 can be distributed in other ways known in the art. In an embodiment, a front face of chemiresistors 120 is coupled to and overlaid by electromagnetic wave shielding material 110. In an embodiment, chemiresistors 120 are coupled to printed circuit board (PCB) 240. In another embodiment, chemiresistors 120 are coupled to a different PCB or another type of circuit board (not shown). In an embodiment, chemiresistors 120 are electronically coupled to microcontroller 130, which is described later with reference to FIG. 3. In an embodiment, chemiresistors 120 are inset in an interior wall of cooking chamber 170 of microwave oven 100.

Chemical injector 140 operates to inject a chemical (e.g., oxygen ($O_2$)), which is safe for human consumption, into cooking chamber 170 of microwave oven 100. In an embodiment, chemical injector 140 is activated when a cooking cycle is started in microwave oven 100. In an embodiment, chemical injector 140 injects a chemical into cooking chamber 170 of microwave oven 100 to cause a chemical reaction with a chemical that leaches from a food container during the cooking process. From this chemical reaction, a vapor and/or gas of a hazardous chemical is released that is detectable by chemiresistors 120. In an embodiment, chemical injector 140 is inset in an interior wall of cooking chamber 170 of microwave oven 100.

Chemical injector 140 is used in embodiments in which chemiresistors 120 cannot detect for a specific hazardous chemical but can detect for a by-product of a chemical reaction between the chemical injected into cooking chamber 170 of microwave oven 100 and the chemical leached from a food container. For example, if there is no chemiresistor to detect for BPA ($C_{15}H_{16}O_2$) but there is a chemiresistor to detect for carbon dioxide ($CO_2$), chemical injector 140 injects oxygen ($O_2$) into the cooking chamber of the microwave oven to cause a chemical reaction, ultimately producing by-products carbon dioxide ($CO_2$) and water ($H_2O$).

Digital display 150 and keypad 160 operate as local user interfaces on microwave oven 100. In an embodiment, digital display 150 and keypad 160 operate as local user interfaces that provide outputs to the user and accepts inputs from the user, respectfully. Digital display 150 provides information to the user in an alphanumeric way using characters, numbers, symbols, and/or letters. Keypad 160 receives information from the user through alphanumeric keys and functional keys. For example, keypad 160 includes, but is not limited to, numeric keys for numbers 1 through 9, a functional key to add 30 seconds to a cooking time, etc. In an embodiment, digital display 150 and keypad 160 are coupled to the front face of microwave oven 100. In an embodiment, digital display 150 and/or keypad 160 are electronically coupled to microcontroller 130, which is described later with reference to FIG. 3.

Cooking chamber 170 operates to enclose a cooking area within microwave oven 100. In an embodiment, cooking chamber 170 is a shielded enclosure, similar to a Faraday cage, that prevents microwave radiation from escaping to the environment outside the cooking area of microwave oven 100. In an embodiment, cooking chamber 170 is contained within microwave oven 100.

Figure 2B:
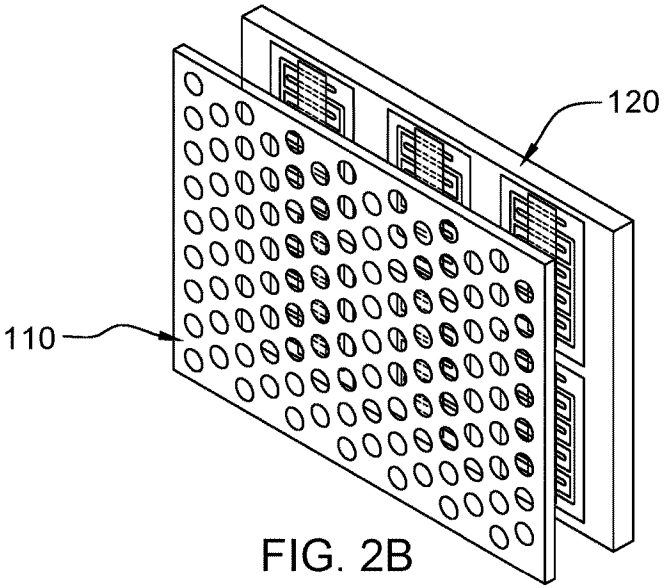
FIG. 2B depicts a perspective view of electromagnetic wave shielding material overlaying chemiresistors, in accordance with an embodiment of the present invention.
Figure 2A:
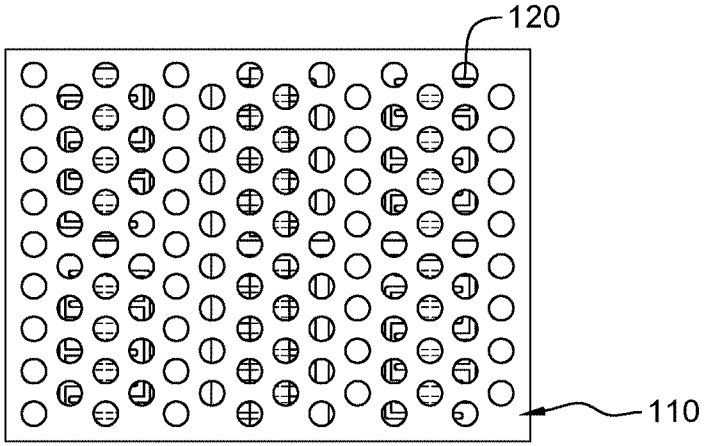
FIG. 2A depicts a front view of electromagnetic wave shielding material overlaying chemiresistors, in accordance with an embodiment of the present invention.

FIG. 2A depicts a front view of electromagnetic wave shielding material 110 overlaying chemiresistors 120, in accordance with an embodiment of the present invention. FIG. 2A provides only an illustration of one embodiment and does not imply any limitations with regard to environments in which different embodiments may be implemented.

FIG. 2B depicts a perspective view of electromagnetic wave shielding material 110 overlaying chemiresistors 120, in accordance with an embodiment of the present invention. In an embodiment, electromagnetic wave shielding material 110 and chemiresistors 120 are inset in the interior side wall of microwave oven 100. In an embodiment, electromagnetic wave shielding material 110 and chemiresistors 120 are inset in the interior wall of microwave oven 100 closest to digital display 150 and keypad 160. FIG. 2B provides only an illustration of one embodiment and does not imply any limitations with regard to environments in which different embodiments may be implemented.

Figure 2C:
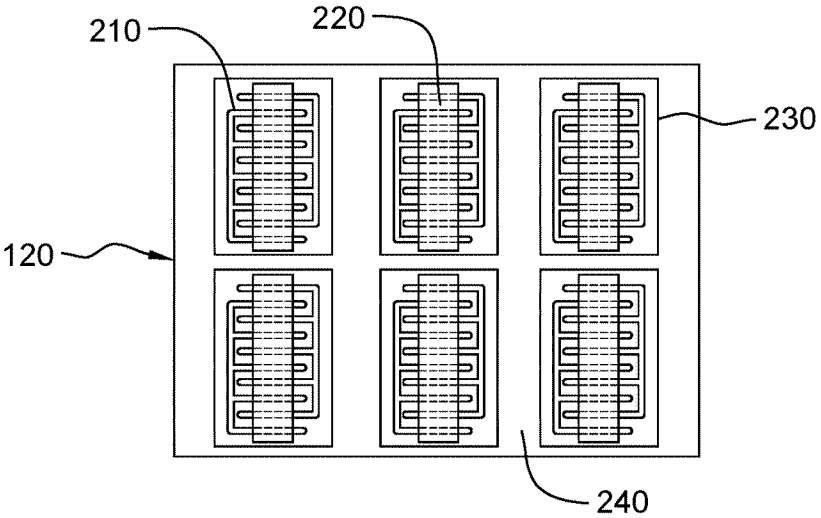
FIG. 2C depicts a front view of chemiresistors, in accordance with an embodiment of the present invention.

FIG. 2C depicts a front view of chemiresistors 120, in accordance with an embodiment of the present invention. In the depicted embodiment, chemiresistors 120 includes six chemiresistors. In other embodiments (not shown), chemiresistors 120 includes any number of chemiresistors. In the depicted embodiment, each chemiresistor of chemiresistors 120 is composed of charge carrier 210, polymer film sensor 220, and substrate 230. Polymer film sensor 220 can detect one type of vapor and/or gas of a hazardous chemical, referred to as the "target chemical". In an embodiment, the electrical resistance of a chemiresistor changes when an electrical charge is applied across polymer film sensor 220 and polymer film sensor 220 absorbs the vapors and/or gases of a hazardous chemical that reaches polymer film sensor 220. In some embodiments, a change in a chemiresistor's resistance indicates the presence of the target chemical. In other embodiments, a change in a chemiresistor's resistance is proportional to the amount of target chemical present. In that case, the chemiresistor will output a value equivalent to the amount of the chemical present. In an embodiment, chemiresistors 120 are coupled to the physical surface of PCB 240. In other embodiments, chemiresistors 120 are coupled to a different PCB or another type of circuit board (not shown). FIG. 2C provides only an illustration of one embodiment and does not imply any limitations with regard to environments in which different embodiments may be implemented.

Figure 3:
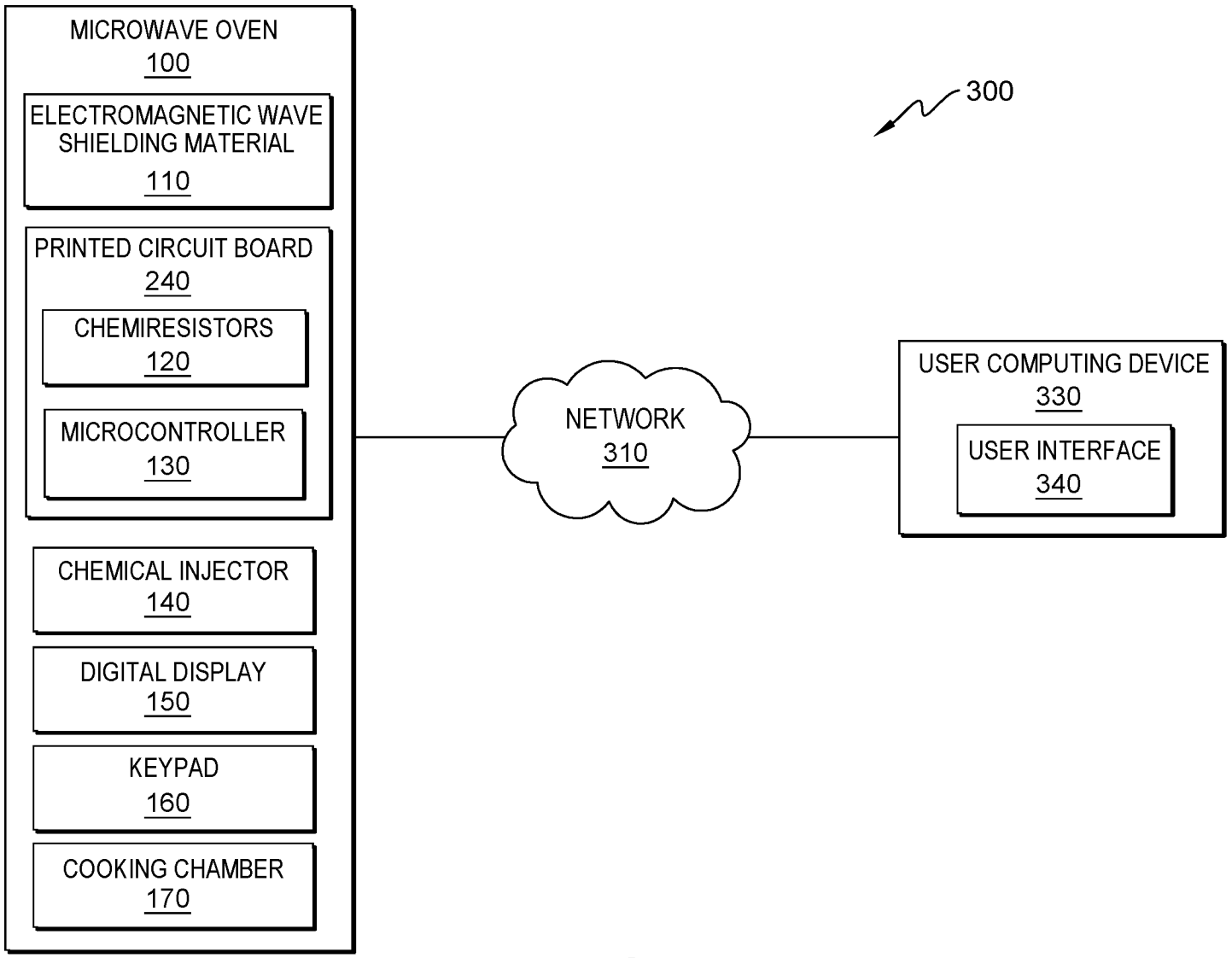
FIG. 3 depicts a functional block diagram illustrating a microwave oven environment, in accordance with an embodiment of the present invention.

FIG. 3 depicts a functional block diagram illustrating microwave oven environment 300, in accordance with an embodiment of the present invention. FIG. 3 provides only an illustration of one embodiment and does not imply any limitations with regard to the environments in which different embodiments may be implemented. In the depicted embodiment, microwave oven environment 300 includes microwave oven 100 and user computing device 330 interconnected over network 310. Microwave oven environment 300 may include additional computing devices, servers, components, or other devices not shown.

Network 310 operates as a computing network that can be, for example, a telecommunications network, a local area network (LAN), a wide area network (WAN), such as the Internet, or a combination of the three, and can include wired, wireless, or fiber optic connections. Network 310 can include one or more wired and/or wireless networks capable of receiving and transmitting data, voice, and/or video signals, including multimedia signals that include voice, data, and video information. In general, network 310 can be any combination of connections and protocols that will support communications between microwave oven 100 and user computing device 330.

Microwave oven 100 operates similarly to microwave oven 100 of FIG. 1. Microwave oven 100 operates to cook, heat, melt, or defrost food by means of high-frequency electromagnetic waves called microwaves. In the depicted embodiment, microwave oven 100 includes electromagnetic wave shielding material 110, chemiresistors 120, microcontroller 130, chemical injector 140, digital display 150, keypad 160, and cooking chamber 170.

Microcontroller 130 operates to receive readings from one or more chemiresistors (i.e., chemiresistors 120), to determine if a pre-set threshold is met, and to output an alert to a user, if necessary. In an embodiment, microcontroller 130 outputs an alert to a user if chemiresistors 120 return a "true" reading, rather than a "false" reading. In another embodiment, microcontroller 130 outputs an alert if chemiresistors 120 have a change in resistance above a pre-set threshold. In an embodiment, microcontroller 130 sends an alert to digital display 150. In another embodiment, microcontroller 130 sends an alert to user computing device 330. The function of microcontroller 130 is described in further detail with respect to FIG. 4.

In an embodiment with a single chemiresistor that outputs a "true" or "false" reading, microcontroller 130 outputs an alert if the chemiresistor returns a "true" reading, rather than a "false" reading. In an embodiment with a plurality of chemiresistors that output a "true" or "false" reading and detect for the same chemical, microcontroller 130 outputs an alert if a majority of the chemiresistors return a "true" reading, rather than a "false" reading. For example, chemiresistors 120 is composed of three chemiresistors detecting for $CO_2$. If two of the three chemiresistors detect $CO_2$ and return a "true" reading, then microcontroller 130 outputs an alert. In an embodiment with a plurality of chemiresistors that output a "true" or "false" reading and detect for different chemicals, microcontroller 130 outputs an alert if a majority of the chemiresistors detecting for the same chemical return a "true" reading, rather than a "false" reading. For example, chemiresistors 120 is composed of nine chemiresistors detecting for three different chemicals (e.g., three chemiresistors detect for $CO_2$, three chemiresistors detect for BPA, and three chemiresistors detect for a phthalate). If two of the three chemiresistors detecting for $CO_2$ return a "true" reading, then microcontroller 130 outputs an alert.

In an embodiment with a single chemiresistor that outputs a numerical value, microcontroller 130 outputs an alert if the chemiresistor has a change in resistance above a pre-set threshold. In an embodiment with a plurality of chemiresistors that output a numerical value and detect for the same chemical, microcontroller 130 outputs an alert if a majority of the chemiresistors have a change in resistance above a pre-set threshold. For example, chemiresistors 120 is composed of three chemiresistors detecting for $CO_2$. If two of the three chemiresistors have a change in resistance above a pre-set threshold, then microcontroller 130 outputs an alert that $CO_2$ was detected. In an embodiment with a plurality of chemiresistors that output a numerical value and detect for different chemicals, microcontroller 130 outputs an alert if a majority of the chemiresistors detecting for the same chemical have a change in resistance above a pre-set threshold. For example, chemiresistors 120 is composed of nine chemiresistors detecting for three different chemicals (e.g., three chemiresistors detect for $CO_2$, three chemiresistors detect for BPA, three chemiresistors detect for a phthalate). If two of the three chemiresistors detecting for $CO_2$ have a change in resistance above a pre-set threshold, then microcontroller 130 outputs an alert that $CO_2$ was detected.

User computing device 330 operates to run user interface 340. In some embodiments, user computing device 330 may be, but is not limited to, an electronic device, such as a laptop computer, a tablet computer, a netbook computer, a personal computer (PC), a desktop computer, a smart phone, a personal digital assistant (PDA), a television, a wearable electronic device, or any programmable electronic device capable of running user interface 340 and communicating with microwave oven 100 via network 310. In some embodiments, user computing device 330 represents one or more programmable electronic devices or combination of programmable electronic devices capable of executing machine readable program instructions and communicating with other computing devices (not shown) within microwave oven environment 300 via a network, such as network 310. In one embodiment, user computing device 330 represents one or more devices associated with a user. In the depicted embodiment, user computing device 330 includes an instance of user interface 340. User computing device 330 may include components as described in further detail in FIG. 5.

User interface 340 operates as a local user interface on user computing device 330. In some embodiments, user interface 340 is a graphical user interface (GUI), a web user interface (WUI), and/or a voice user interface (VUI) that can display or present (i.e., audibly) alerts including information (such as graphics, text, and/or sound) sent from microcontroller 130 to a user. In an embodiment, user interface 340 is capable of receiving and sending data (i.e., from and to microcontroller 130, respectively). For example, user interface 340 enables a user to end a cooking cycle of microwave oven 100. In an embodiment, user interface 340 enables a user to configure a threshold (i.e., resistance of chemiresistors 120) for which microcontroller 130 uses in decision 440, which is described later with reference to FIG. 4.

Figure 4:
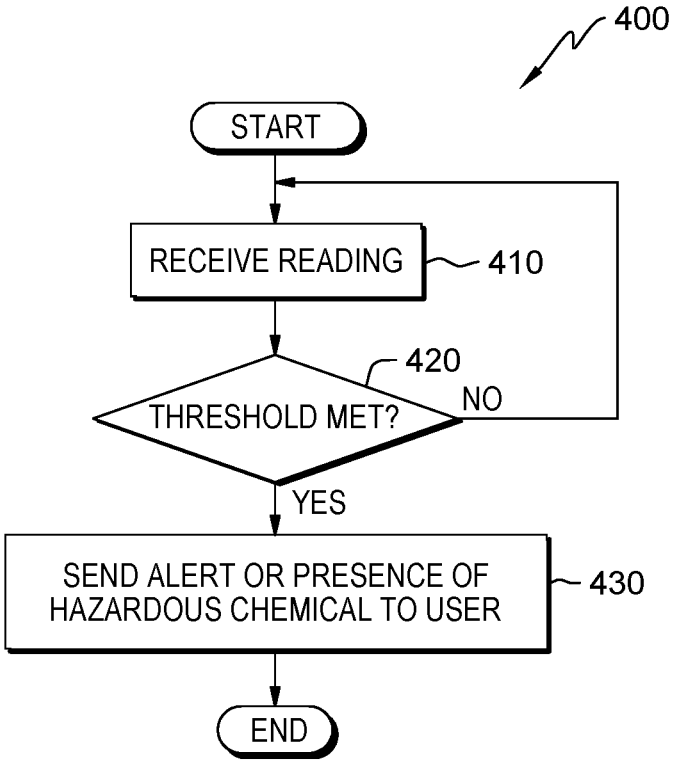
FIG. 4 depicts a flowchart of the steps of a function of a microcontroller of the microwave oven, in accordance with an embodiment of the present invention.

FIG. 4 depicts a flowchart of the steps of a function of microcontroller 130 of microwave oven 100, in accordance with an embodiment of the present invention. In an embodiment, microcontroller 130 receives a reading from chemiresistors 120. In an embodiment, microcontroller 130 determines whether a pre-set threshold is met. In an embodiment, microcontroller 130 sends an alert to a user. It should be appreciated that the process depicted in FIG. 4 illustrates one possible iteration of the process flow, which repeats for each cooking cycle initiated on microwave oven 100.

Microwave oven 100 has an air circulation system with openings in the front wall, bottom wall and rear wall of cooking chamber 170. The purpose of this air circulation system is to cool various electrical components, such as the magnetron, and to direct the air through cooking chamber 170 to a discharge region. The air circulation system also oscillates the air within cooking chamber 170. By circulating the air within cooking chamber 170 in a continually rhythmic manner, the vapors and/or gases of hazardous chemicals are pushed past chemiresistors 120, allowing for detection to occur. Detection occurs when the vapors and/or gases of hazardous chemicals are absorbed by polymer film sensor 220 of chemiresistors 120, changing the electrical resistance of chemiresistors 120.

In an embodiment, chemiresistors 120 detect for a vapor and/or gas of a hazardous chemical released from a food container into cooking chamber 170 of microwave oven 100 during a cooking cycle. In an embodiment in which chemical injector 140 injects a chemical into cooking chamber 170 of microwave oven 100, chemiresistors 120 detect for a vapor and/or gas of a hazardous chemical released from a chemical reaction that occurred between the injected chemical and the hazardous chemical leached from a food container. In an embodiment, chemiresistors 120 starts detecting for a vapor and/or gas of a hazardous chemical when a cooking cycle begins and stops detecting for a vapor and/or gas of a hazardous chemical when the cooking cycle ends.

In step 410, microcontroller 130 receives a reading from chemiresistors 120. In an embodiment, microcontroller 130 receives a reading from chemiresistors 120 after chemiresistors 120 detects a vapor and/or gas of a hazardous chemical. In some embodiments, microcontroller 130 receives either a "true" or a "false" reading. In other embodiments, microcontroller 130 receives a numerical value denoting a change in electrical resistance of the chemiresistors that detected a vapor and/or gas of a hazardous chemical. In an embodiment, a chemiresistor's resistance change is proportional to the amount of target chemical present.

In decision 420, microcontroller 130 determines whether a pre-set threshold is met. In an embodiment, microcontroller 130 determines whether a pre-set threshold is met by assessing the readings received in step 410. If microcontroller 130 determines the pre-set threshold has been met (decision 420, YES branch), then microcontroller 130 sends an alert notifying a user to the presence of the hazardous chemical (step 430). If microcontroller 130 determines the pre-set threshold has not been met (decision 420, NO branch), then microcontroller 130 waits for additional readings while microwave oven 100 completes a cooking cycle. If no additional readings are received or the pre-set threshold is not met by the end of the cooking cycle, then microcontroller 130 ends the function.

In an embodiment with a single chemiresistor that returns either a "true" or a "false" reading, the pre-set threshold is met when the chemiresistor returns a "true" reading. In an embodiment with a plurality of chemiresistors that return either a "true" or a "false" reading, the pre-set threshold is met when a majority of the chemiresistors detecting for the same chemical return a "true" reading.

In an embodiment with a single chemiresistor that changes its electrical resistance in response to the presence of a chemical, the pre-set threshold is met when the chemiresistor's change in resistance reaches a certain numerical value. In an embodiment with a plurality of chemiresistors that change their electrical resistance in response to the presence of a chemical, the pre-set threshold is met when a majority of the chemiresistors detecting for the same chemical have a change in resistance that reaches a certain numerical value. The certain numerical value can be set by a user through user interface 340 or could be pre-set by a manufacturer of microwave oven 100.

In step 430, microcontroller 130 sends an alert. In an embodiment, microcontroller 130 sends an alert to a user. In an embodiment, microcontroller 130 sends an alert notifying the user to the presence of a hazardous chemical in microwave oven 100. In an embodiment, microcontroller 130 sends an alert to digital display 150. In other embodiments, microcontroller 130 sends an alert to user computing device 330 to be output to a user through user interface 340.

Figure 5:
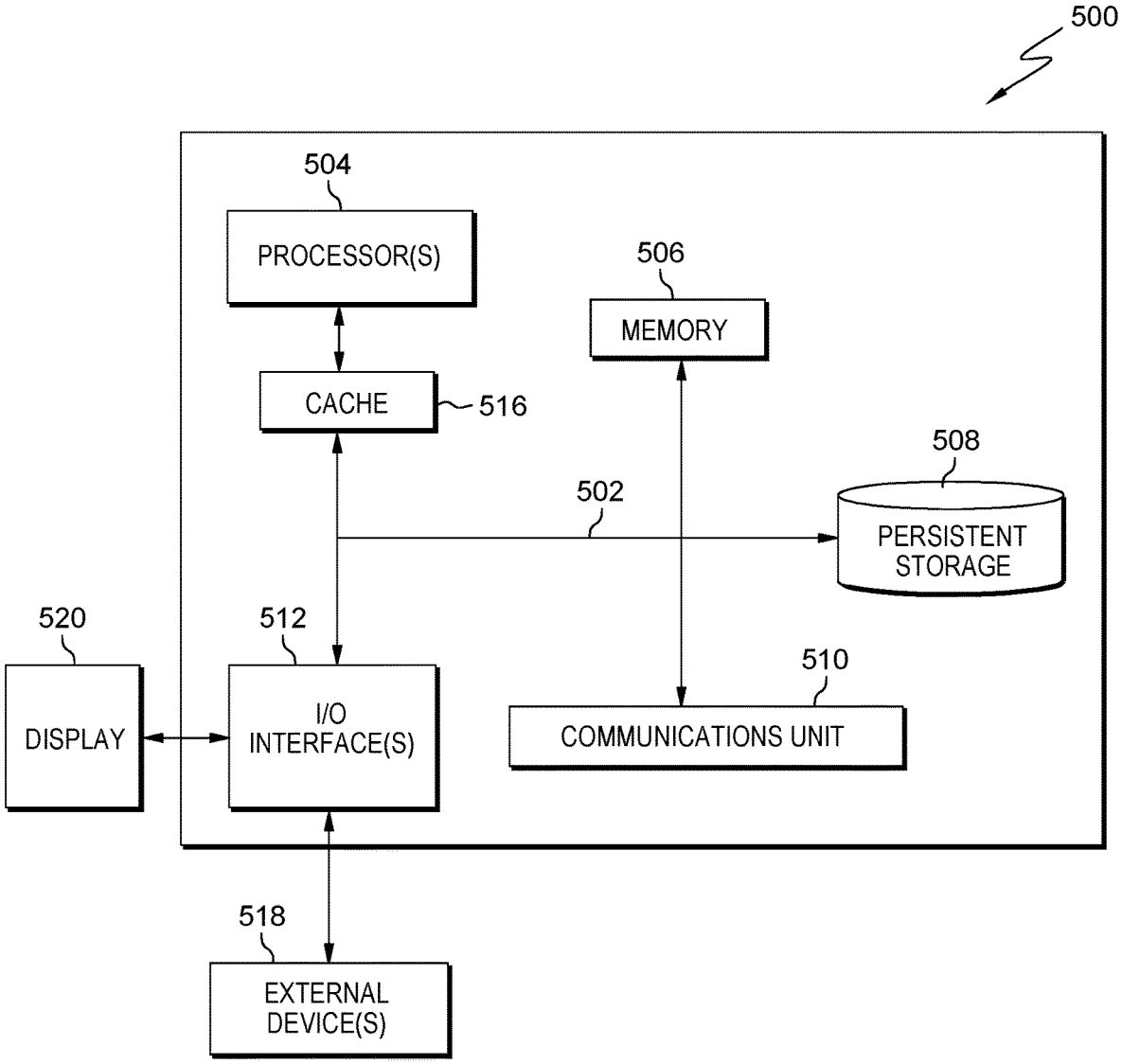
FIG. 5 depicts a block diagram of a computing device of the microwave oven environment, in accordance with an embodiment of the present invention.

FIG. 5 depicts a block diagram of a computing device, generally designated computer 500, of microwave oven environment 300, such as microwave oven 100 and/or user computing device 330, in accordance with an embodiment of the present invention. It should be appreciated that FIG.

5 provides only an illustration of one implementation and does not imply any limitations with regard to the environments in which different embodiments may be implemented. Many modifications to the depicted environment may be made.

As depicted, computer 500 includes a communications fabric 502, which provides communications between cache 516, memory 506, persistent storage 508, communications unit 510, and input/output (I/O) interface(s) 512. Communications fabric 502 can be implemented with any architecture designed for passing data and/or control information between processors (such as microprocessors, communications and network processors, etc.), system memory, peripheral devices, and any other hardware components within a system. For example, communications fabric 502 can be implemented with one or more buses.

Memory 506 and persistent storage 508 are computer-readable storage media. In this embodiment, memory 506 includes random access memory (RAM). In general, memory 506 can include any suitable volatile or non-volatile computer-readable storage media. Cache is a fast memory that enhances the performance of computer processor(s) 504 by holding recently accessed data, and data near accessed data, from memory 506.

Programs may be stored in memory 506 and in persistent storage 508 for execution and/or access by one or more of the respective computer processors 504 via cache 516. In an embodiment, persistent storage 508 includes a magnetic hard disk drive. Alternatively, or in addition to a magnetic hard disk drive, persistent storage 508 can include a solid state hard drive, a semiconductor storage device, read-only memory (ROM), erasable programmable read-only memory (EPROM), flash memory, or any other computer-readable storage media that is capable of storing program instructions or digital information.

The media used by persistent storage 508 may also be removable. For example, a removable hard drive may be used for persistent storage 508. Other examples include optical and magnetic disks, thumb drives, and smart cards that are inserted into a drive for transfer onto another computer-readable storage medium that is also part of persistent storage 508.

Communications unit 510, in these examples, provides for communications with other data processing systems or devices. In these examples, communications unit 510 includes one or more network interface cards. Communications unit 510 may provide communications through the use of either or both physical and wireless communications links. Programs may be downloaded to persistent storage 508 through communications unit 510.

I/O interface(s) 512 allows for input and output of data with other devices that may be connected to microwave oven 100 and user computing device 330. For example, I/O interface 512 may provide a connection to external devices 518 such as a keyboard, keypad, a touch screen, and/or some other suitable input device. External devices 518 may also include portable computer-readable storage media such as, for example, thumb drives, portable optical or magnetic disks, and memory cards. Software and data used to practice embodiments of the present invention may be stored on such portable computer-readable storage media and may be loaded onto the persistent storage 508 via I/O interface(s) 512. The I/O interface(s) 512 may similarly connect to a display 520.

Display 520 provides a mechanism to display data to a user and may be, for example, a computer monitor.

Programs described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the invention. The terminology used herein was chosen to best explain the principles of the embodiment, the practical application or technical improvement over technologies found in the marketplace, or to enable others of ordinary skill in the art to understand the embodiments disclosed herein.

What is claimed is:

1. A microwave oven comprising:

an electromagnetic wave shielding material;

at least one chemiresistor;

a microcontroller;

a chemical injector inset in an interior side wall of a cooking chamber of the microwave oven; wherein the chemical injector is configured to inject a chemical into the cooking chamber of the microwave oven to cause a chemical reaction with a first chemical that leached from a food container during a cooking cycle to produce a second chemical that the at least one chemiresistor can detect;

a digital display; and wherein: the at least one chemiresistor is overlaid by the electromagnetic wave shielding material, and the microcontroller is electronically coupled to the digital display.

2. The microwave oven of claim 1, wherein the electromagnetic wave shielding material is configured to protect the at least one chemiresistor against an electromagnetic field created within a cooking chamber of the microwave oven.

3. The microwave oven of claim 1, wherein a first chemiresistor of the at least one chemiresistor is configured to detect for a first chemical in the microwave oven.

4. The microwave oven of claim 3, wherein a second chemiresistor of the at least one chemiresistor is configured to detect for a second chemical in the microwave oven.

5. The microwave oven of claim 1, wherein the at least one chemiresistor comprises a plurality of chemiresistors that each detect for a different chemical.

6. The microwave oven of claim 1, wherein the at least one chemiresistor is coupled to a printed circuit board and inset in an interior side wall of a cooking chamber of the microwave oven.

7. The microwave oven of claim 1, wherein the microcontroller is configured to output an alert when the at least one chemiresistor detects a chemical.

8. The microwave oven of claim 1, wherein the digital display is configured to operate as a local user interface on the microwave oven and displays an alert output by the microcontroller.

9. The microwave oven of claim 1, wherein the chemical injector is configured to inject a chemical into the cooking chamber of the microwave oven to cause a chemical reaction with a first chemical that leached from a food container during a cooking cycle to produce a second chemical that the at least one chemiresistor can detect.

10. A method comprising:

receiving, by a microcontroller of a microwave oven, a reading from each of at least three chemiresistors inset in an interior side wall of the microwave oven, wherein each of the at least three chemiresistors is configured to detect one chemical;

determining, by the microcontroller, whether a pre-set threshold is met by a majority of the at least three chemiresistors; and responsive to determining the pre-set threshold is met by the majority of the at least three chemiresistors, sending, by the microcontroller, an alert.

11. The method of claim 10, wherein the reading from each of the at least three chemiresistors is a true or a false reading.

12. The method of claim 10, wherein the reading from each of the at least three chemiresistors is a value denoting an amount of the chemical detected.

13. The method of claim 10, wherein sending the alert comprises:

sending, by the microcontroller, the alert to a digital display of the microwave oven.

14. The method of claim 10, wherein sending the alert comprises:

outputting, by the microcontroller, the alert to through a user interface of a user computing device.

15. A computer system comprising:

one or more computer processors;

one or more computer-readable storage media;

program instructions stored on the computer-readable storage media for execution by at least one of the one or more processors, the program instructions comprising:

program instructions to receive a reading from each of at least three chemiresistors inset in an interior side wall of the microwave oven, wherein each of the at least three chemiresistors is configured to detect one chemical;

program instructions to determine whether a pre-set threshold is met by a majority of the at least three chemiresistors; and responsive to determining the pre-set threshold is met by the majority of the at least three chemiresistors, program instructions to send an alert.

16. The computer system of claim 15, wherein the reading from each of the at least three chemiresistors is a true or a false reading.

17. The computer system of claim 15, wherein the reading from each of the at least three chemiresistors is a value denoting an amount of the chemical detected.

18. The computer system of claim 15, wherein sending the alert comprises:

program instructions to send the alert to a digital display of the microwave oven.

19. The computer system of claim 15, wherein sending the alert comprises:

program instructions to output the alert to through a user interface of a user computing device.

* * * * *